United States Patent [19]

Kodama et al.

[11] Patent Number: 4,917,064

[45] Date of Patent: Apr. 17, 1990

[54] METHOD OF AND APPARATUS FOR GENERATING CYLINDER DISCRIMINATING SIGNAL IN DISTRIBUTOR FOR INTERNAL COMBUSTION ENGINE

[75] Inventors: Seiki Kodama; Shigemi Murata; Hideki Maruhashi, all of Hyogo, Japan

[73] Assignee: Mitsubishi Denki Kabushiki Kaisha, Tokyo, Japan

[21] Appl. No.: 222,663

[22] Filed: Jul. 21, 1988

[30] Foreign Application Priority Data

Jul. 24, 1987 [JP] Japan ..... 62-185936

[51] Int. Cl.[4] ..... F02P 1/00; F02P 5/04

[52] U.S. Cl. ..... 123/414; 123/612; 123/617

[58] Field of Search ..... 123/414, 612, 617, 146.5 A

[56] References Cited

U.S. PATENT DOCUMENTS

| | | | |
|---|---|---|---|
| 4,165,726 | 8/1979 | Helmer, Jr. | 123/617 |
| 4,343,285 | 8/1982 | Brammer et al. | 123/612 |
| 4,462,347 | 7/1984 | Brammer et al. | 123/617 |
| 4,463,715 | 8/1984 | Brammer | 123/617 |
| 4,635,353 | 1/1987 | Tamagne | 123/617 |
| 4,677,946 | 7/1987 | Tamagne | 123/617 |
| 4,719,883 | 1/1988 | Yokoyama et al. | 123/617 |
| 4,742,811 | 5/1988 | Okada et al. | 123/617 |
| 4,747,382 | 5/1988 | Suzuki et al. | 123/414 |
| 4,766,865 | 8/1988 | Härtel | 123/414 |
| 4,787,355 | 11/1988 | Maeda | 123/414 |

*Primary Examiner*—Raymond A. Nelli

*Attorney, Agent, or Firm*—Sughrue, Mion, Zinn, Macpeak and Seas

[57] ABSTRACT

A method of and apparatus for generating a cylinder discriminating signal in a distributor for an internal combustion engine are disclosed. The cylinder discriminating signal is generated by a combination of a cylinder discriminating reluctor installed on a centrifugal spark advance member and a cylinder discriminating sensor attached to a vacuum spark advance plate to detect approach and passage of the cylinder discriminating reluctor. The width of the cylinder discriminating reluctor in the direction of rotation is set so as to correspond to an angle smaller than the entire range of spark advance of the ignition timing signal. The cylinder discriminating signal is advanced by both centrifugal spark advance and vacuum spark advance so as to overlap the ignition timing signal despite having a relatively narrow width. Since the width of the cylinder discriminating signal is reduced, it is possible to improve the control tolerances of the associated microcomputer.

4 Claims, 3 Drawing Sheets

METHOD OF AND APPARATUS FOR GENERATING CYLINDER DISCRIMINATING SIGNAL IN DISTRIBUTOR FOR INTERNAL COMBUSTION ENGINE

BACKGROUND OF THE INVENTION

1. Field of the Invention

The present invention relates to a method of and apparatus for generating a cylinder discriminating signal in a distributor for an internal combustion engine.

2. Description of the Related Art

FIG. 4 shows a conventional distributor for an internal combustion engine. In the figure, the reference numeral 1 denotes a distributor housing, 2 a cap, 3 a rotary shaft rotated synchronously with the internal combustion engine, 4 a reluctor for a cylinder discriminating signal which is rotated together with the rotary shaft (hereinafter referred to as "cylinder discriminating reluctor"), 5 a sensor disposed to face the reluctor 4 so as to generate a cylinder discriminating signal when the rotary shaft is rotated, 9 a reluctor for detecting ignition timing (hereinafter referred to as "ignition timing reluctor"), 10 a stator constituting a part of the magnetic circuit of the ignition timing reluctor, and 30 a vacuum spark advance plate to which the stator 10 is attached (it should be noted that the mechanism for activating the vacuum spark advance plate 30 is not shown). The reference numeral 6 denotes a magnet signal type generator for generating an ignition signal for each of the cylinders, 7 an ignition timing control unit for controlling the ignition signal generated from the magnet signal type generator 6 on the basis of the positional relationship between the reluctor 9 and the stator 10, that is, according to whether or not the reluctor 9 and the stator 10 face each other, 8 a centrifugal spark advance controller, 81 a governor base fixed to the rotary shaft, 82, 83 weights, and 84 a centrifugal spark advance plate. The reference numeral 11 denotes a spark advance sleeve loosely fitted on the rotary shaft 3. The ignition timing reluctor 9 is attached to the spark advance sleeve 11. The sensor 5 is attached to the outer surface of the cylindrical part of the distributor housing 1 in such a manner that the sensing surface 51 of the sensor 5 is exposed in the housing 1. The cylinder discriminating reluctor 4 is fixed to the governor base 81 of the centrifugal spark advance controller 8. The functional part of the cylinder discriminating reluctor 4 approaches and passes the sensing surface 51 of the sensor 5 when the rotary shaft 3 is rotated together with the reluctor 4.

In the case of a four-cylinder engine, the rotary shaft 3 is rotated one full turn per two full turns of the crankshaft (not shown) of the engine, so that four ignition timing signals and one cylinder discriminating signal are output per one full turn of the shaft 3. A cylinder which is defined as a standard is detected by the cylinder discriminating signal from the sensor 5, and the signal is supplied to a fuel injecting device corresponding to the cylinder so that fuel is injected when the valve of the cylinder is opened. Then, ignition is conducted on the basis of the ignition timing signal for each of the cylinders.

In the above-described conventional distributor, the ignition timing signal IG which is generated by the reluctor 9 is advanced with respect to TDC of the engine crank angle, whereas the cylinder discriminating signal G generated by the reluctor 4 is not advanced, as shown in FIG. 5. Therefore, in order to enable the signal G to overlap the signal IG so as to detect a cylinder, the width $\theta_A$ of the signal G must be greater than the entire range of spark advance, i.e., $\theta_1+\theta_2$, where $\theta_1$ is the maximum centrifugal spark advance and $\theta_2$ is the maximum vacuum spark advance. For this reason, the width of the functional part of the reluctor 4 must be $\theta_A$, as shown in FIG. 3b. Accordingly, the width of the signal generated by the combination of the cylinder discriminating reluctor 4 and the sensor 5 is disadvantageously wide, and the wide reluctor 4 leads to an increase in the amount of imbalance during rotation.

SUMMARY OF THE INVENTION

In view of the above-described problems of the prior art, it is a primary object of the present invention to obtain a cylinder discriminating signal which has a reduced width and which is suitable for digital treatment.

To this end, according to the present invention, the cylinder discriminating reluctor is installed on a centrifugal spark advance member, and the cylinder discriminating sensor is attached to the vacuum spark advance plate.

Since the cylinder discriminating reluctor is secured to a centrifugal spark advance member, for example, a centrifugal spark advance plate, through a centrifugal spark advance mechanism, there is no change in the rotational angle position of the cylinder discriminating reluctor with respect to the ignition timing reluctor. Further, since the cylinder discriminating sensor is secured to the vacuum spark advance plate, there is no change in the rotational angle position of the cylinder discriminating sensor with respect to the stator. Therefore, the cylinder discriminating signal G is advanced in the same way as the ignition timing signal IG. Accordingly, it is possible to make the width of the functional part of the cylinder discriminating reluctor narrower than that of the prior art.

BRIEF DESCRIPTION OF THE DRAWINGS

The above and other objects, features and advantages of the present invention will become more apparent from the following description of the preferred embodiment thereof, taken in conjunction with the accompanying drawings, in which like reference numerals denote like elements, and in which.

DESCRIPTION OF THE PREFERRED EMBODIMENT

Figure 1:
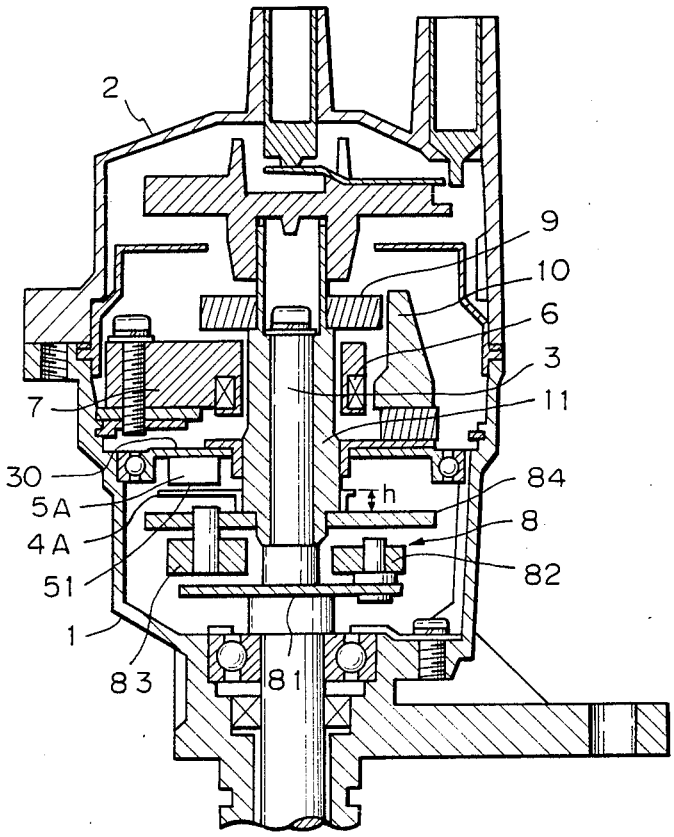
FIG. 1 is a longitudinal cross-sectional view of a distributor for an internal combustion engine according to one embodiment of the present invention.
Figure 3:
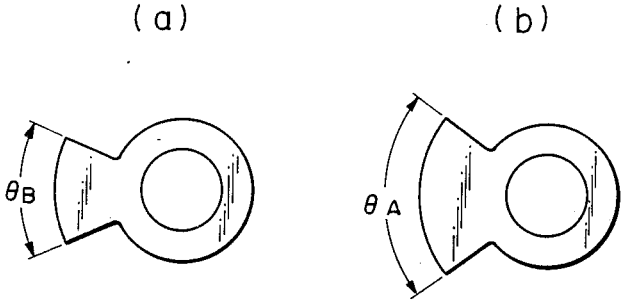
FIGS. 3(*a*) and 3(*b*) show a width comparison between the functional part of the cylinder discriminating reluctor according to the present invention and that of the prior art.
Figure 4:
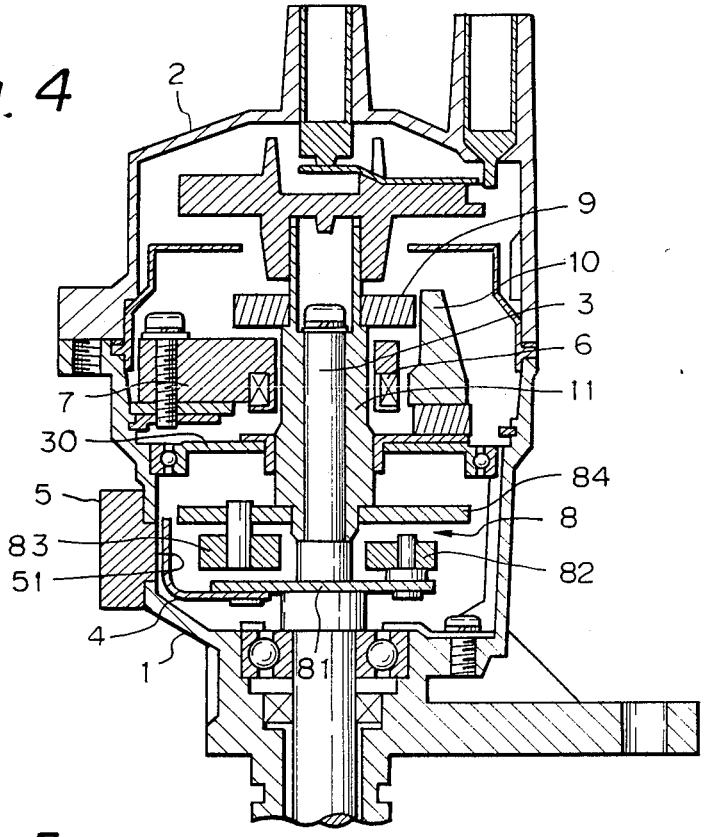
FIG. 4 is a longitudinal cross-sectional view of a conventional distributor for an internal combustion engine.
Figure 5:
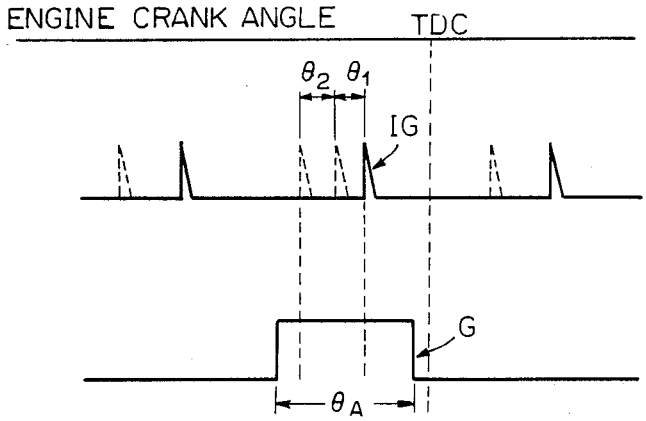
FIG. 5 shows the relationship between the cylinder discriminating signal G and ignition timing signal IG in the prior art.

Referring to FIG. 1, which is a longitudinal cross-sectional view of a distributor for an internal combustion engine according to one embodiment of the present invention, the reference numerals 1 to 3, 6 to 11, 30, 51 and 81 to 84 denote the same elements or portions as those shown in FIG. 4. The reference numeral 4A denotes a cylinder discriminating reluctor according to the present invention which is secured to the centrifugal spark advance plate 84 so as to rotate together with the centrifugal spark advance sleeve 11. The reference numeral 5A denotes a cylinder discriminating sensor which is attached to the vacuum spark advance plate 30 so as to rotate together with the stator 10. It should be noted that the functional part of the illustrated reluctor 4A has a sectorial shape as shown in FIG. 3. The functional part of the reluctor 4A is disposed at such a level that it is able to approach and pass the sensing surface 51 of the cylinder discriminating sensor 5A.

Figure 2:
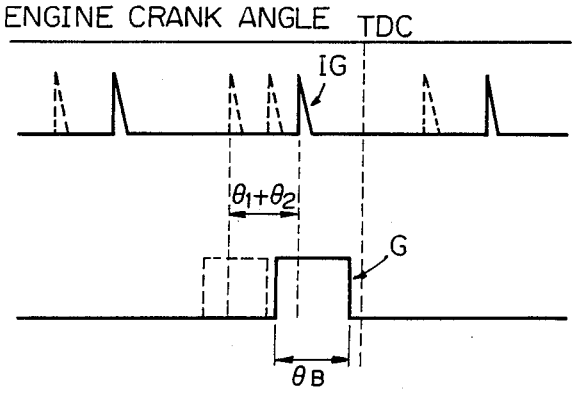
FIG. 2 shows the relationship between the cylinder discriminating signal G and ignition timing signal IG in the present invention.

Referring next to FIG. 2, which shows the relationship between the cylinder discriminating signal G and ignition timing signal IG in the present invention, it will be understood that the signal G is centrifugally advanced in the same way as the signal IG. This is because both the ignition timing reluctor 9 and the cylinder discriminating reluctor 4A are attached to the spark advance sleeve 11 and both the stator 10 and the cylinder discriminating sensor 5A are attached to the vacuum spark advance plate 30.

Thus, it is possible to reduce the width of the functional part of the cylinder discriminating reluctor 4A, as shown b $\theta_B$ in FIG. 3*a*.

Accordingly, the width of the cylinder discriminating signal obtained from the sensor 5A is narrower than that in the case of the prior art, so that it is possible to improve the control tolerances of the associated microcomputer.

As has been described above, according to the present invention, the cylinder discriminating reluctor is secured to the centrifugal spark advance plate, and the cylinder discriminating sensor is secured to the vacuum spark advance plate. Therefore, the cylinder discriminating signal is advanced together with the ignition timing signal, so that it is possible to narrow the width of the functional part of the cylinder discriminating reluctor 4A. Accordingly, it is possible to reduce the amount of imbalance of the cylinder discriminating reluctor 4A about the rotary shaft 3 and hence reduce both the weight and size of the cylinder discriminating reluctor 4A. In addition, since the width of the cylinder discriminating signal G is reduced, it is possible to improve the control tolerances of the associated microcomputer.

Although the present invention has been described through specific terms, it should be noted here that the described embodiment is not necessarily exclusive and various changes and modifications may be imparted thereto without departing from the scope of the invention which is limited solely by the appended claims.

What is claimed is:

1. An apparatus for generating a cylinder discriminating signal in a distributor for an internal combustion engine having a rotary shaft rotated synchronously with said internal combustion engine, a centrifugal spark advance member rotated through a centrifugal spark advance mechanism so that said member revolves relative to said rotary shaft, an ignition timing reluctor provided on said centrifugal spark advance member, a vacuum spark advance plate, and ignition timing signal generating means for generating an ignition timing signal by detecting approach and passage of said ignition timing reluctor with respect to sensing means provided on said vacuum spark advance plate, wherein the improvement comprises a cylinder discriminating reluctor installed on said centrifugal spark advance member, and a cylinder discriminating sensor attached to said vacuum spark advance plate to generate a cylinder discriminating signal by detecting approach and passage of said cylinder discriminating reluctor.

2. The apparatus according to claim 1, wherein said cylinder discriminating reluctor is attached to a centrifugal spark advance plate.

3. The apparatus according to claim 1, wherein said cylinder discriminating reluctor has a width in the direction of rotation which corresponds to an angle smaller than the entire range of spark advance of the ignition timing signal.

4. A method of generating a cylinder discriminating signal in a distributor for an internal combustion engine having a rotary shaft rotated synchronously with said internal combustion engine, a centrifugal spark advance member rotated through a centrifugal spark advance mechanism so that said member revolves relative to said rotary shaft, an ignition timing reluctor provided on said centrifugal spark advance member, a vacuum spark advance plate, and ignition timing signal generating means for generating an ignition timing signal by detecting approach and passage of said ignition timing reluctor with respect to sensing means provided on said vacuum spark advance plate, said method comprising generating a cylinder discriminating signal by a combination of a cylinder discriminating reluctor installed on said centrifugal spark advance member, said cylinder discriminating reluctor having a width in the direction of rotation which corresponds to an angle smaller than the entire range of spark advance of the ignition timing signal, and a cylinder discriminating sensor attached to said vacuum spark advance plate to detect approach and passage of said cylinder discriminating reluctor, so that the cylinder discriminating signal is advanced by both centrifugal spark advance and vacuum spark advance so as to overlap the ignition timing signal over the entire range of spark advance of the ignition timing signal.

* * * * *